United States Patent [19]

Herman et al.

[11] Patent Number: 4,508,005

[45] Date of Patent: Apr. 2, 1985

[54] QUICK RELEASE MECHANISM FOR RATCHET WRENCH

[75] Inventors: Timm R. Herman; Frank Mikic, both of Kenosha, Wis.

[73] Assignee: Snap-on Tools Corporation, Kenosha, Wis.

[21] Appl. No.: 563,196

[22] Filed: Dec. 19, 1983

[51] Int. Cl.[3] ..... B25B 13/00

[52] U.S. Cl. ..... 81/177 85; 81/60

[58] Field of Search ..... 81/60–62, 81/177 G; 403/325, 328

[56] References Cited

U.S. PATENT DOCUMENTS

| | | |
|---|---|---|
| 1,533,619 | 4/1925 | Thompson . |
| 2,474,360 | 6/1949 | Jimerson . |
| 2,675,257 | 4/1954 | Specht . |
| 2,721,090 | 10/1955 | Kaman . |
| 3,118,696 | 1/1964 | Resare . |
| 3,208,318 | 9/1965 | Roberts . |
| 3,438,291 | 4/1969 | Bergquist . |
| 3,638,519 | 2/1972 | Rebold . |
| 3,713,356 | 1/1973 | Knudsen . |
| 3,762,245 | 10/1973 | Smyers et al. . |
| 3,777,596 | 12/1973 | Smyers, Jr. et al. . |
| 3,924,493 | 12/1975 | Penner . |
| 4,187,747 | 2/1980 | Pawlow . |
| 4,292,863 | 10/1981 | Hickman . |
| 4,399,722 | 8/1973 | Sardo, Jr. . |

*Primary Examiner*—James G. Smith

*Attorney, Agent, or Firm*—Emrich & Dithmar

[57] ABSTRACT

The mechanism, used in a ratchet wrench, includes a body carrying an integral stud. A bore extends axially into both and a formed-spring actuator is reciprocally mounted therein. A transverse bore in the stud slidably holds a pin which is connected to the actuator. A socket is applied to the mechanism by pushing the socket against a camming surface on the pin to enable the socket to be snapped onto the pin without operating the actuator. The socket is removed by depressing the actuator. A ramp-like structure in the bore engages an offset part of the formed-spring actuator causing it to divert and move the pin to its release position. An elastomer push button is preferably attached to the actuator to sealingly protect the mechanism and also to provide a nice appearance.

18 Claims, 8 Drawing Figures

QUICK RELEASE MECHANISM FOR RATCHET WRENCH

BACKGROUND OF THE INVENTION

A ratchet wrench typically includes a handle and a head which is adapted to releasably engage one of a plurality of sockets of different sizes. A most important feature of a ratchet wrench is its capability of removing a socket quickly and easily.

Generally, prior mechanisms in the marketplace included a ball-and-spring structure. The socket has a side hole into which the ball snaps as the socket is applied to the mechanism. The socket is removed by simply pulling it off. Alternately, such mechanism has a push-button actuator, which is depressed to remove the socket, thus the name "quick-release" mechanism. Whether or not an actuator is provided, the socket can be removed by forcibly pulling it off. This is disadvantageous because a socket has a tendency to fall off inadvertently during use. The socket could be lost or it could fall into a place where it could cause damage to equipment and/or injury to persons. Particularly when these ratchet wrenches are used in industry, inadvertent dislodgement is highly undesirable.

To preclude the socket from inadvertently falling off during use, certain mechanisms in the marketplace do not permit the socket to be simply pulled off. They have positive locking structure which precludes forcibly pulling the socket off of the ratchet wrench. Instead, a punch or the like must be inserted into the mechanism to release the socket.

Other prior art mechanisms have a built-in actuator which is operated to remove the socket. But, such prior-art actuators require a more complex action than is desired. Or, they must be operated not only to release the socket, but also to apply the socket.

SUMMARY OF THE INVENTION

It is therefore an important object of the present invention to provide an improved quick release mechanism used in a ratchet wrench.

Another object is to provide a quick release mechanism for a ratchet wrench to which a socket can be snapped into place without operating the actuator.

Another object is to provide a quick release mechanism for a ratchet wrench from which the socket can be removed only by operating the actuator.

Another object is to provide a quick release mechanism for a ratchet wrench having an actuator of the push button variety which need only be depressed to enable removal of the socket.

In summary, there is provided mechanism for locking and releasing an elongated socket having a side hole, comprising a generally cylindrical body, a non-annular stud extending from the body and being coaxial therewith, the body and the stud having an axially extending first bore therein, an abutment in the first bore, a formed-spring actuator slidable in the first bore and having first and second end portions and an intermediate portion, the intermediate portion at rest lying against the abutment, the first end portion being oriented so as to be movable by a person's finger, said stud having a second bore therein extending substantially normal to said first bore, a pin slidably located in the second bore and movable between locking and release positions, the second end portion engaging the pin, the pin being biased toward its locking position, the pin having a portion transversely protruding from the stud in the locking position, the protruding portion having locking and camming surfaces, a socket being applied to the mechanism by pushing the socket against the camming surface to move the pin to its release position and then pushing the socket until the pin snaps to its locking position and into the socket side hole, the socket being removed from the mechanism by depressing the first end portion to cause the intermediate portion to ride along the abutment and carry the pin to its release position, thereby withdrawing the pin from the socket aperture to enable the socket to slip off of the stud.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
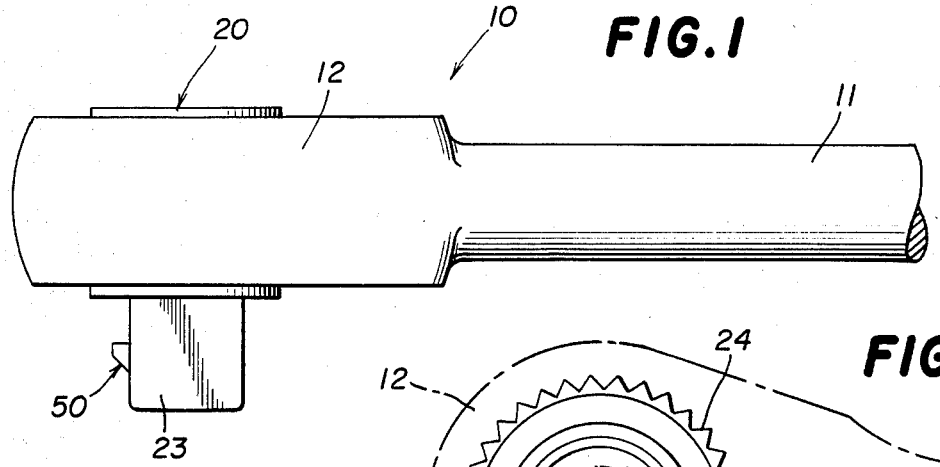
FIG. 1 is a fragmentary view of a ratchet wrench including a release and locking mechanism that incorporates the features of the present invention.
Figure 2:
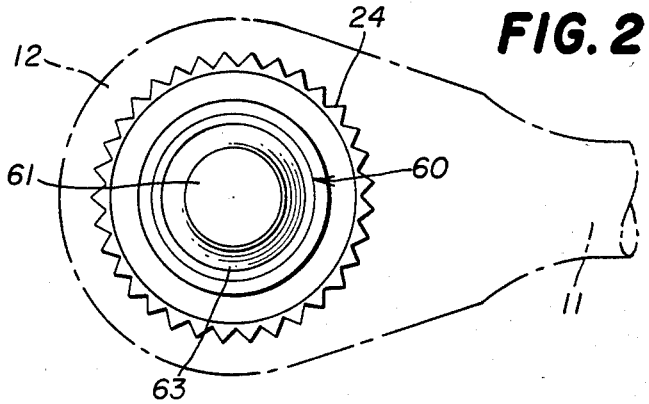
FIG. 2 is a top plan view of the head of the socket wrench of FIG. 1 with the handle and mechanism holding structure being shown in phantom.
Figure 3:
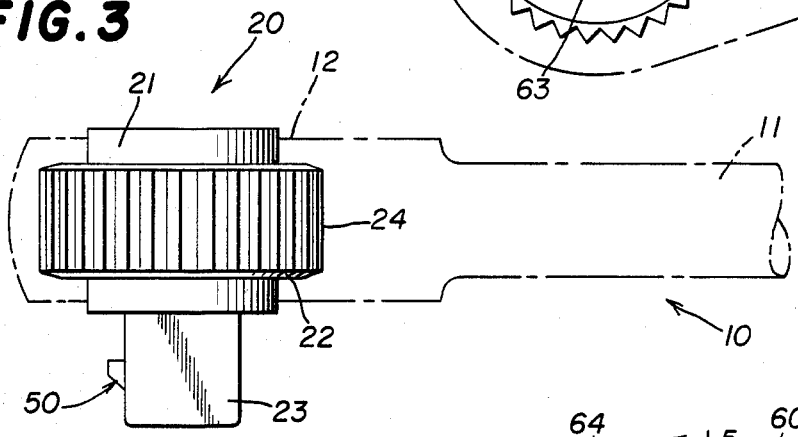
FIG. 3 is a side elevational view of the locking and release mechanism in the ratchet wrench of FIG. 1, the handle and head for the mechanism being shown in phantom.
Figure 6:
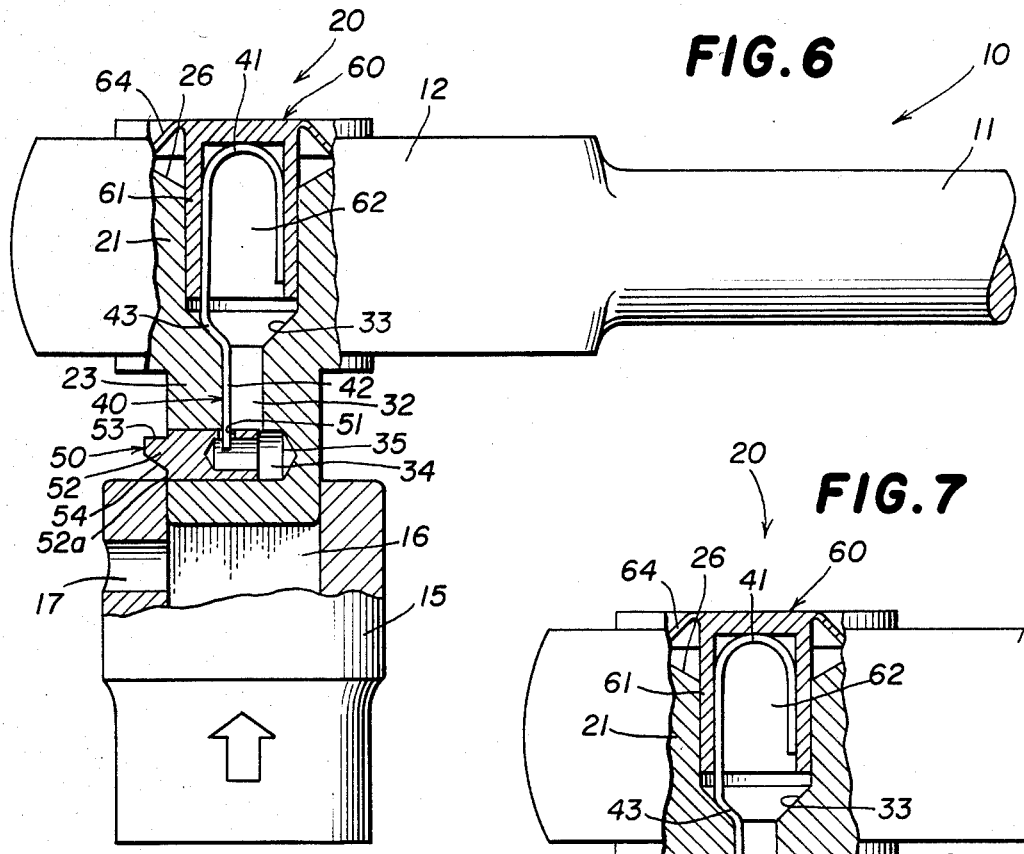
FIG. 6 is a fragmentary view of the ratchet wrench in which the head is cut away to expose the locking and release mechanism, such mechanism being shown in section, a socket being also shown partly in section and partly in full.
Figure 7:
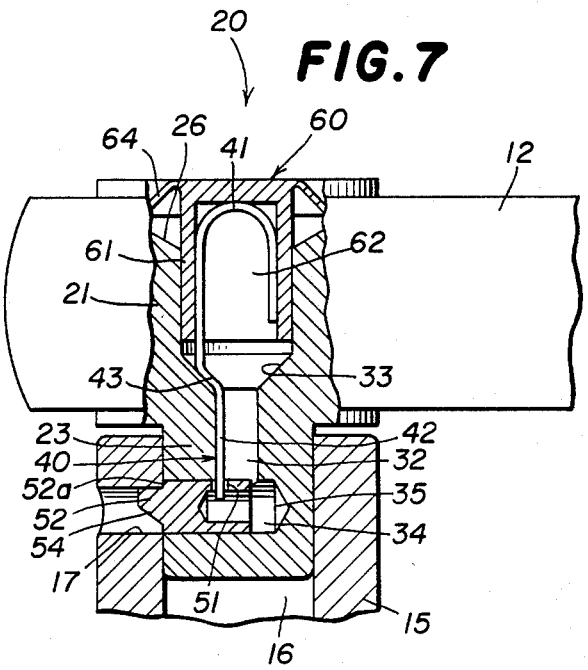
FIG. 7 is a view like FIG. 6 after the parts have been assembled.

Turning now to the drawings, there is illustrated in FIGS. 1–3 a ratchet wrench 10 having a handle 11 and a yoke or head 12. The ratchet wrench 10 carries a stud 23 which is square in the embodiment depicted. Referring to FIG. 6, the ratchet wrench 10 is adapted to releasably retain a socket 15 having an axially extending cavity 16 that matches the shape of the stud 23, here square. In the side wall of the socket 15 is an aperture or side hole 17 for use in receiving detent or locking mechanism of the wrench 10, as will be described. Although the side hole 17 is shown to extend all the way through the wall of the socket 15, that is not necessary. Instead, it could be a recess that receives the detent mechanism.

Figure 4:
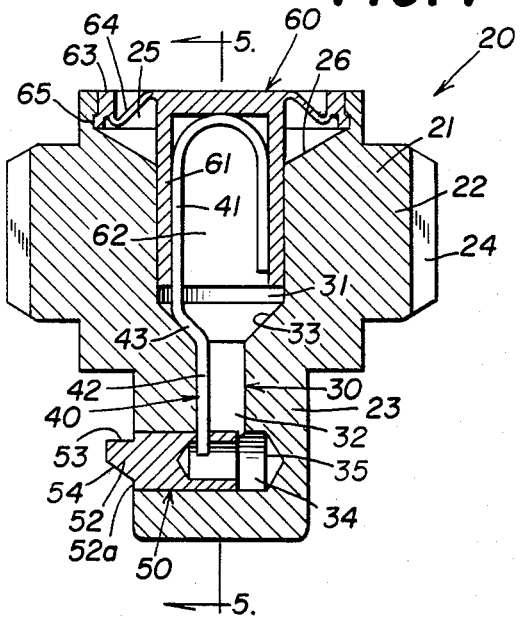
FIG. 4 is a view in vertical section of the locking and release mechanism of FIG. 3, on an enlarged scale.
Figure 5:
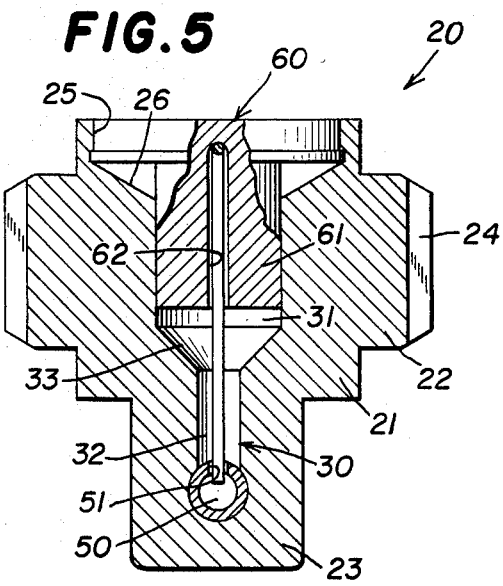
FIG. 5 is a view in vertical section taken along the line 5—5 of FIG. 4.

Referring back to FIGS. 2 and 3 and also to FIGS. 4 and 5, the ratchet wrench 10 includes a mechanism 20 carried by the head 12. The mechanism 20 includes a generally cylindrical, one-piece body 21 having an enlarged cylindrical portion 22 and the stud 23. The stud 23 is non-annular as previously stated, is elongated and has its longitudinal axis coaxial with the axis of the body 21. A ratchet surface 24 is formed on the exterior of the enlarged portion 22. The ratchet surface 24 engages with mating structure (not shown) in the head 12. The ratchet surface 24 and the mating structure are well known in the prior art, serving to rotate the body 21 in one direction and then to slip or ratchet in the other direction so as to enable unidirectional motion of the body 21 and engaged socket. The wrench 10 usually has a lever (not shown) which enables reversal of the direction of rotation. In one end of the body 21 (upper as viewed in FIG. 5) there is provided a recess 25 having a stepped cylindrical surface coaxial with the axis of the body 21. The base 26 of the recess 25 is frustoconical.

A bore 30 extends through the body 21 and part way into the stud 23, the bore 30 being divided into a larger-diameter portion 31 located entirely in the body 21, and a smaller-diameter portion 32 located partly in the body 21 and partly in the stud 23. A frustoconical ramp 33 joins the two portions 31 and 32. The frustoconical ramp 33 tapers or slopes toward the axis in the direction of the stud 23. The recess 25 communicates with the bore 30.

The stud 23 has therein a bore 34 extending substantially normal to the axis of the bore 30. The rear end of the bore 34 has a flattened conical shape so as to define a stop 35, for a purpose to be described.

The mechanism 20 further comprises a formed-spring actuator 40, being a single length of wire in the embodiment shown. The actuator 40 includes a U-shaped end portion 41, a straight end portion 42 and an intermediate portion 43 between the portions 41 and 42. The portion 42 is disposed almost parallel to the legs of the end portion 41. The intermediate portion 43 slopes substantially at the same angle as the angle of the frustoconical ramp 33.

Figure 8:
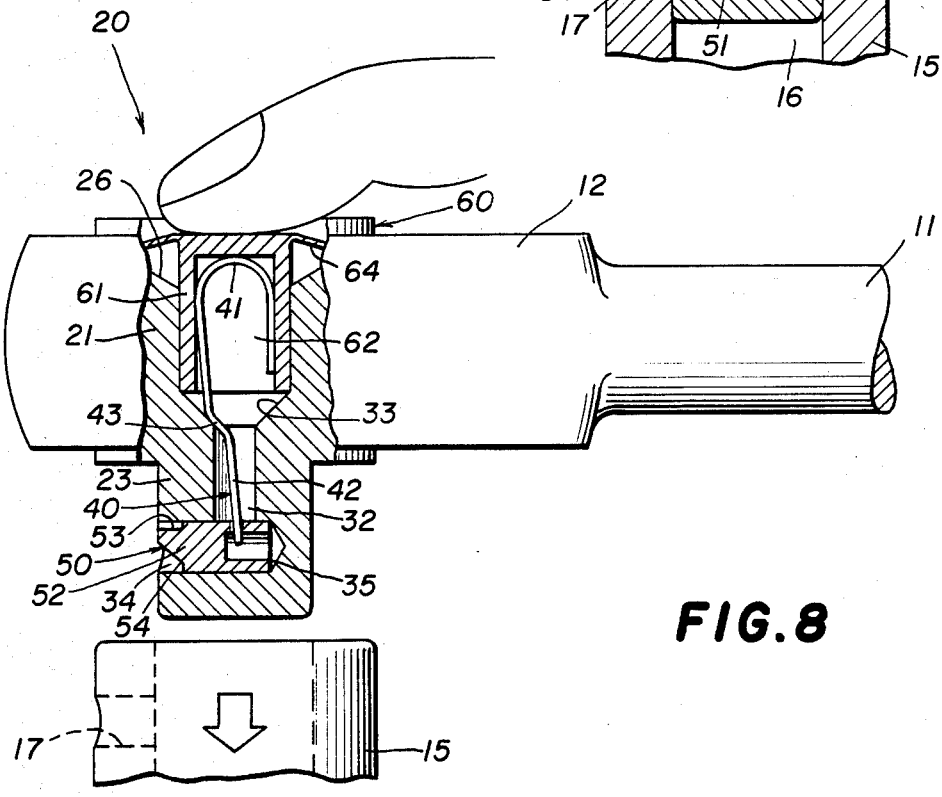
FIG. 8 is a view like FIG. 6 during disassembly.

The mechanism 20 further comprises a pin 50 slidably located in the bore 34, the pin including a radially extending hole 51 that receives the end of the straight end portion 42 of the actuator 40. The pin 50 is generally cylindrical in the embodiment shown. The pin 50 is slidable between a locking condition when the pin is at its forwardmost position and a release condition when it is at its rearmost position entirely within the bore 34 (as shown in FIG. 8). Rearward movement of the pin 50 is limited by engagement thereof with the stop 35. When the pin 50 is in its locking position, its front end portion 52 transversely protrudes forwardly of the stud 23. In the particular embodiment depicted, the diameter of the portion 52 is less than that of the rest of the pin 50, so as to define an annular shoulder 52*a*. The portion 52 has a part-cylindrical locking surface 53. The portion 52 also has a camming surface 54 which faces downwardly, that is, away from the body 21.

The mechanism 20 further comprises a push button 60 which includes a body 61 defined by two crossing vanes. The four outer edges of the cross-shaped body 61 are fragments of a single surface of revolution having a diameter substantially matching the inside diameter of the bore 30. A longitudinally extending slit 62 is located within one of the vanes. The push button 60 also includes an annular rim 63 which is generally rectangular in transverse cross section. A hinge 64 joins the body 61 and the rim 63. An annular foot 65 depends from the rim 63, the exterior surface of the foot 65 being outwardly offset from the outside surface of the rim 63. The rim 63 and the hinge 64 are within the recess 25 to minimize the chances of inadvertently releasing a socket during use. As shown, the foot 65 has a greater diameter than the rim 63. The wall of the recess 25 is stepped. In assembly, the foot 65 is pushed down so that it contacts the base 26, the larger diameter foot 65 snapping into the larger diameter portion of the recess 25. Alternatively, instead of an offset in both the push button 60 and the recess 25, frictional engagement can be employed. In either event, the rim 63 provides a seal against entry of dirt, grease and the like into the bore 30 and the structure contained therein.

The push button 60 is formed of flexible elastomer, such as ZYTEL, so that the body 61 is movable axially with respect to the rim 63. When the body 61 is depressed, the hinge 64 tends to flatten from the frustoconical shape depicted in FIG. 4. The push button 60 is molded in the shape shown so that the body 61 is biased to the position shown in FIG. 4. The body 61 may be depressed against the action of such bias. Upon release, the bias causes the body 61 to return to its stable condition depicted in FIG. 4.

The U-shaped end portion 41 of the actuator 40 is located in the slit 62 of the push button 60. The legs of the U-shaped end portion 41 are spaced apart a distance preferably equal to the width of the slit 62 so that the end portion 41 is frictionally held and retained by the push button 60. Depression of the button 60 is transmitted to the bight of the U-shaped end portion 41 of the actuator 40.

The push button 60 holds the actuator 40 in the condition shown in FIG. 4 and the straight end portion 42 holds the pin 50 outwardly or in its locking position. The actuator 40 may even be slightly stressed so that the portion 42 is biased against the wall of the smaller diameter portion 32 of the bore 30.

Referring to FIG. 6, a socket 15 is applied to the mechanism 20 by aligning the cavity 16 with the stud 23 and then pushing the socket 15 toward the mechanism 20. The upper surface of the socket 15 engages the camming surface 54, causing the pin 50 to move rearwardly until it is entirely within the bore 34 while the socket 15 is pushed upwardly. The end of the portion 52 rides against the wall of the cavity 16 until it becomes aligned with the side hole 17. The actuator 40 then biases the pin 50 to its locking position and, therefore, causes the portion 52 to snappingly enter the side hole 17. The socket 15 cannot be removed by simply pulling it away from the mechanism 20, because the wall of the side hole 17 engages the locking surface 53 to prevent such motion.

To remove the socket 15, the push button 60 is depressed as shown in FIG. 8, causing the intermediate portion 43 to ride downwardly on the ramp 33, such motion deflecting the straight end portion 42 rearwardly to carry the pin 50 to its release position. The portion 52 is disengaged from the side hole 17 so that the socket 15 may be slipped off of the stud 23.

The actuator 40 produces high mechanical efficiency. A small force applied to the push button 60 causes withdrawal of the pin 50 to its release position.

The ramp 33 is not essential to the operation described above. Any abutment which would deflect the intermediate portion 43 rearwardly as the push button 60 is depressed would be satisfactory.

When ones finger is removed from the button 60, the hinge 64 reverts to its normal condition, causing the body portion 61 to revert to the position shown in FIG. 6. The actuator 40 similarly moves upwardly and the pin 50 reverts to its locking position, as depicted in FIG. 6.

Thus, the socket 15 can be slipped onto the stud 23 without operating the push button 60. Once the socket is locked into place, it cannot be removed by simply pulling it. Thus, it cannot inadvertently fall off during use. The push button 60 must be depressed to place the pin 50 in its release position to enable the socket 15 to be removed.

Furthermore, the pin 50 is retained simply by the actuator 40, thereby simplifying manufacture of the mechanism 20. In the past, after the ball-and-spring structure and the pin were inserted, the mouth of the bore 30 would have to be deformed to create a shoulder or abutment. Here, however, the diameter of the mouth is the same as the rest of the bore 30.

We claim:

1. Mechanism for locking and releasing an elongated socket having a side hole, comprising a generally cylindrical body, a non-annular stud extending from said body and being coaxial therewith, said body and said stud having an axially extending first bore therein, an abutment in said first bore, a formed-spring actuator slidable in said first bore and having first and second end portions and an intermediate portion, said intermediate portion at rest lying against said abutment, said first end portion being oriented so as to be movable by a person's finger, said stud having a second bore therein extending substantially normal to said first bore, a pin slidably located in said second bore and movable between locking and release positions, said second end portion engaging said pin, said pin being biased toward its locking position, said pin having a portion transversely protruding from said stud in said locking position, said protruding portion having locking and camming surfaces, a socket being applied to said mechanism by pushing the socket against said camming surface to move said pin to its release position and then pushing the socket until said pin snaps to its locking position and into the socket side hole, the socket being removed from said mechanism by depressing said first end portion to cause said intermediate portion to ride along said abutment and carry said pin to its release position, thereby withdrawing said pin from the socket side hole to enable the socket to slip off of said stud.

2. The mechanism of claim 1, and further comprising a push button operatively connected to said first end portion.

3. The mechanism of claim 1, wherein said abutment divides said bore into a large diameter portion and a small diameter portion, said small-diameter portion communicating with said second bore.

4. The mechanism of claim 3, and further comprising a push button operatively connected to and covering said first end portion and slidably located in said large-diameter portion of said bore.

5. The mechanism of claim 1, wherein said protruding portion is substantially cylindrical.

6. The mechanism of claim 1, wherein said first end portion is U-shaped and has a bight against which one's finger pushes.

7. The mechanism of claim 6, and further comprising a push button receiving said U-shaped first end portion.

8. The mechanism of claim 7, wherein the inside dimension of said push button is substantially equal to the cross dimension of the legs of said U-shaped first end portion so as frictionally to retain said first end portion.

9. The mechanism of claim 1, wherein said formed-spring actuator is a wire.

10. The mechanism of claim 1, wherein said abutment is a ramp in said first bore sloped toward the axis thereof in the direction of said stud.

11. The mechanism of claim 1, wherein said ramp is a frustoconical surface in said bore.

12. The mechanism of claim 1, wherein said second bore has a mouth the same diameter as the rest of said second bore.

13. Mechanism for locking and releasing an elongated socket having a side hole, comprising a generally cylindrical body, a non-annular stud extending from said body and being coaxial therewith, said body and said stud having an axially extending first bore therein, an abutment in said first bore, means defining a cylindrical recess in said body communicating with said first bore and coaxial therewith, a formed-spring actuator slidable in said first bore and having first and second end portions and an intermediate portion, said first end portion protruding into said cylindrical recess, a push button having a body and an annular rim and a hinge, said rim resting on said recess defining means, said hinge means biasing said body away from said stud, said body receiving said first end portion, said intermediate portion at rest lying against said abutment, said stud having a second bore therein extending substantially normal to said first bore, a pin slidably located in said second bore and movable between locking and release positions, said second end portion engaging in said pin, said pin being biased toward its locking position, said pin having a portion transversely protruding from said stud in said locking position, said protruding portion having locking and camming surfaces, a socket being applied to said mechanism by pushing the socket against said camming surface to move said pin to its release position and then pushing the socket until said pin snaps to its locking position and into the socket side hole, the socket being removed from said mechanism by depressing said body portion to cause said intermediate portion to ride along said abutment and carry said pin to its release position, thereby withdrawing said pin from the socket side hole to enable the socket to slip off of said stud.

14. The mechanism of claim 13, wherein said hinge means is frustoconical in its rest position and is flatter when said push button is depressed.

15. The mechanism of claim 13, wherein said recess defining means includes an annular cylindrical wall and a base, said rim sealingly mating with said wall.

16. The mechanism of claim 15, wherein said wall has an offset configuration and said rim has a complementary shape mating with said wall.

17. The mechanism of claim 15, wherein said rim includes an annular member and an annular foot resting on said base, said hinge being integral with and extending from said annular member.

18. The mechanism of claim 13, wherein said abutment is a ramp in said first bore sloped toward the axis thereof in the direction of said stud.

* * * * *